US010647480B2

(12) United States Patent
Davis et al.

(10) Patent No.: US 10,647,480 B2
(45) Date of Patent: May 12, 2020

(54) CLOSURE WITH HINGED LID

(71) Applicant: BLACKHAWK MOLDING CO., INC., Addison, IL (US)

(72) Inventors: Jeffrey S. Davis, DeKalb, IL (US); Douglas J. Hidding, Barrington Hills, IL (US)

(73) Assignee: BLACKHAWK MOLDING CO., INC., Addison, IL (US)

( * ) Notice: Subject to any disclaimer, the term of this patent is extended or adjusted under 35 U.S.C. 154(b) by 201 days.

(21) Appl. No.: 15/816,660

(22) Filed: Nov. 17, 2017

(65) Prior Publication Data

US 2018/0072471 A1 Mar. 15, 2018

Related U.S. Application Data

(63) Continuation-in-part of application No. 14/305,086, filed on Jun. 16, 2014, now abandoned.

(51) Int. Cl.
*B65D 47/08* (2006.01)
*E05D 11/10* (2006.01)
(Continued)

(52) U.S. Cl.
CPC ..... *B65D 47/0885* (2013.01); *B65D 43/164* (2013.01); *B65D 51/10* (2013.01); *E05D 11/105* (2013.01); *B65D 2101/0015* (2013.01)

(58) Field of Classification Search
CPC .. A45D 40/22; A45D 40/221; B65D 47/0857; B65D 47/0885; B65D 47/0895; B65D 47/0861; B65D 47/0866
See application file for complete search history.

(56) References Cited

U.S. PATENT DOCUMENTS 2,764,200 A 9/1956 Gits
2,950,847 A 8/1960 Tupper
(Continued)

FOREIGN PATENT DOCUMENTS

JP 2001104046 A 4/2001
KR 20110007097 7/2011
(Continued)

OTHER PUBLICATIONS

The 1st Examination and Search Report in co-pending British Application No. 1510193.4 dated Nov. 3, 2015.
(Continued)

*Primary Examiner* — Andrew T Kirsch
(74) *Attorney, Agent, or Firm* — Baker & McKenzie

(57) ABSTRACT

A closure for a container of the kind use to deliver milk and juice. The closure is a two-piece construction comprise of a lid and a base. The closure preferably has overall dimensions that approximate a standard unitary cap use with the same containers, so that the closure can easily be used with standard feeding equipment in a bottling facility. The closure has a hinge that is formed of a post connected by a tab to the lid, and hinge supports extending upwardly from the closure's base. The hinge supports include a hook and a bridge. The hook allows the tab to slide under the hook during assembly of the lid to the base. Once the tab is positioned between hook and the bridge, the hook blocks disassembly of the lid from the base. The post of the hinge assembly fits within tunnel sections formed by the hook and the bridge, and gripping forces applied by the hook and/or bridge hold the lid in an open position when contents are poured from the container. In an alternative embodiment, the post of the hinge has a rounded protrusion extending axially along the length of the post. A ledge on the upper surface of the base
(Continued)

is engaged by the rounded protrusion to hold the lid in a partially open position.

20 Claims, 5 Drawing Sheets

(51) Int. Cl.
*B65D 43/16* (2006.01)
*B65D 51/10* (2006.01)

(56) References Cited

U.S. PATENT DOCUMENTS 3,503,544 A 3/1970 Setera
3,710,419 A * 1/1973 De Groft ..... E05D 7/105 16/257
4,291,818 A 9/1981 Nozawa et al.
4,488,667 A 12/1984 Swett et al.
4,513,888 A 4/1985 Curry
4,589,431 A 5/1986 Yuhara
4,595,123 A 6/1986 Libit
4,666,068 A 5/1987 Bush
4,821,899 A 4/1989 Nycz et al.
4,881,647 A * 11/1989 Schiemann ..... B65D 41/04 206/510
4,942,271 A 7/1990 Corsi et al.
4,993,606 A * 2/1991 Bolen, Jr. ..... B65D 47/0885 215/235
5,167,351 A 12/1992 Prout et al.
5,346,099 A * 9/1994 Salmon ..... B65D 47/0861 220/832
5,427,265 A 6/1995 Cautereels et al.
5,588,546 A 12/1996 Farside
5,638,838 A 6/1997 Lombardi
5,942,729 A 8/1999 Carlson, Jr. et al.
6,070,749 A 6/2000 Joulia
6,263,543 B1 7/2001 Daoud
6,702,109 B1 3/2004 Toa
6,979,777 B2 12/2005 Marcou et al.
7,469,090 B2 12/2008 Ferris et al.
2010/0294790 A1 11/2010 Lin
2012/0312832 A1 12/2012 Lane
2013/0134176 A1 5/2013 Fuglie et al.

FOREIGN PATENT DOCUMENTS

KR 20120007739 U 11/2012
WO 2011101519 A1 8/2011
WO 2014201645 A1 12/2014

OTHER PUBLICATIONS

A page from http:www.plastic-craft.com/snap-hinge-1-1-2-x-1-1-2.html, describing a snap hinge.
The 1st Examiner's Report in co-pending Canadian Application No. 2894095 dated Dec. 7, 2016.

* cited by examiner

CLOSURE WITH HINGED LID

This is a continuation-in-part application of U.S. patent application Ser. No. 14/305,086, filed Jun. 16, 2014.

BACKGROUND AND SUMMARY

The closures shown and described are for use with containers for beverages, such as milk, other dairy products and juice. Containers that are blow-molded by bottlers of dairy and juice drinks closures have typically been used with simple threaded or push-on closures with flat integral lids. The closures require some form of tamper indicating feature, a popular version of which is the use of a foil liner placed on the interior of the closure. The foil liner is subsequently sealed against and connected to the neck of the container at an induction sealing station after the container is filled and after the closure is installed on the container.

Closures for bottled water (e.g., 28 mm diameter) have in recent years been supplied with a wide variety of flip top designs in which an easily openable and closeable lid is carried by a threaded closure base, and such flip-top features are popular. Flip top features, however, have not typically been included on larger diameter closures (e.g., 38 mm) of the kind used on blow-molded gallon, half-gallon and quart sized containers, perhaps because of cost concerns and/or the difficulty of designing a flip-top feature that will not cause problems when run through existing feeding equipment that is in place in bottling facilities. Some relatively large closures have been designed with integral hinges, known as a "butterfly" hinge, an example of which is shown in U.S. Pat. No. 5,588,546. Such hinges are a form of living hinge, and tend to break easily.

The closures described herein have a two-piece design that includes a flip top feature, and yet they are compatible with existing feeding equipment used in numerous dairies and other beverage bottling operations. The closures described herein also have the advantage to a closure supplier of allowing a single or standard color base component to be used with lids of different colors. This allows a closure supplier to quickly and efficiently respond to orders for closures, because instead of having to mold closures to fill an order for a particular colored closure, the supplier can simply assembly lids of a particular color lid to a standard base.

BRIEF DESCRIPTIONS OF THE DRAWINGS

DETAILED DESCRIPTION

Figure 1:
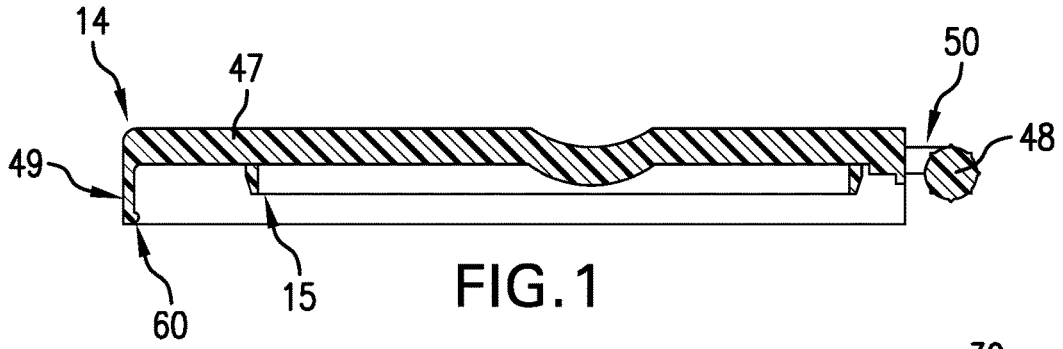
FIG. 1 is a cross-sectional view of a lid of the closure of the present invention.

FIG. 1 depicts the upper one of a two-component closure, i.e., the lid 14 having a cover 47 and a lid skirt 49. Extending rearwardly from the cover 47 is a post 48 joined to the lid by tab 50. A downwardly depending plug 15 extends from the underside of the cover 47. On the portion of the lid skirt 49, at a location which is diametrically opposite the location of the post 48, a small latch bead 60 extends inwardly from the lower end of the lid skirt 49.

Figure 2:
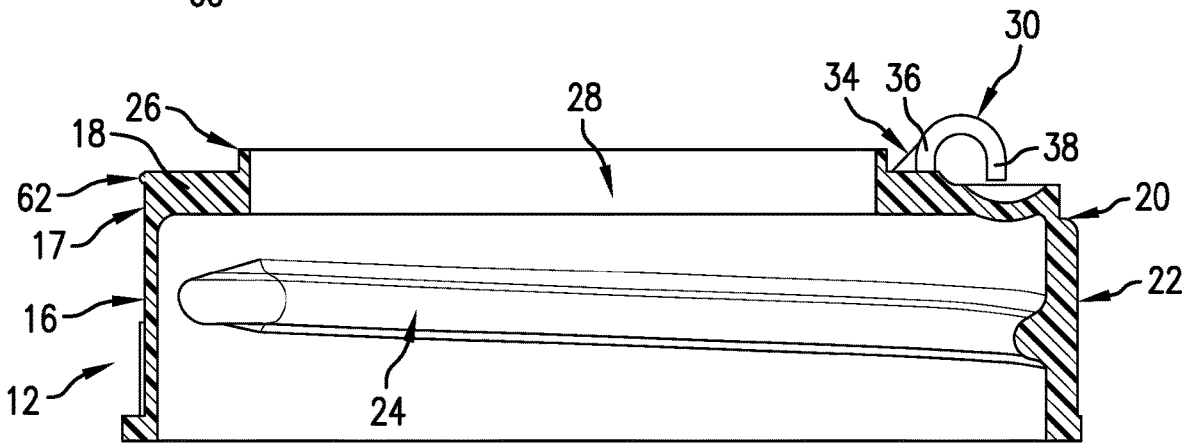
FIG. 2 is cross-sectional of the base of the closure of the present invention.

FIG. 2 shows the base 12, which together with the lid 14 of FIG. 1, forms a closure 10 as described herein. The base 12 includes a skirt 16 having a single internal thread 24 integrally informed on the inside surface of the skirt 16. A single thread 24 is preferable, because it ensures that the closure, when installed on a container having handle, aligns correctly, such that the lid 14 opens in a direction directly toward the handle. See the discussion of FIGS. 7 and 8 below. This allows the contents of the container to be dispensed without interfering with the lid 14. A flange 18 extends inwardly from the upper end of the skirt 16, and the flange 18 surrounds an opening 28 formed in the central portion of the base 12. An upwardly extending sealing lip 26 is formed on the inside upper edge of the flange 18. The lip 26 is intended to engage and sealingly abut the plug 15 formed on the underside of the cover 47 of the lid 14.

Figure 3:
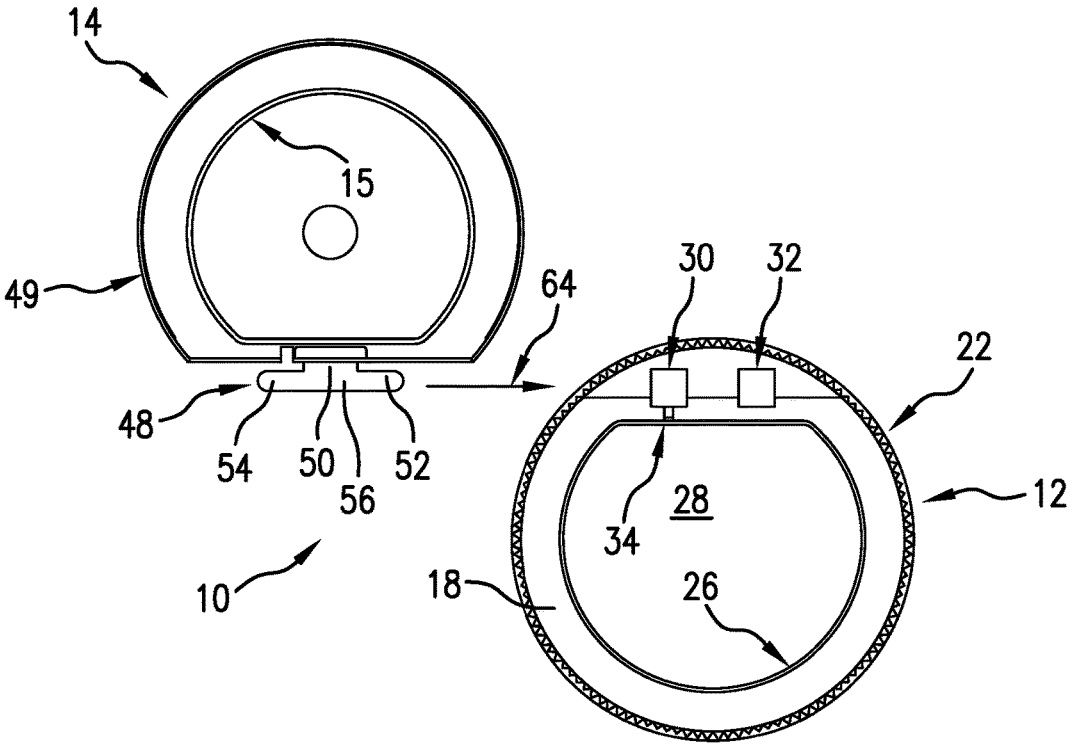
FIG. 3 is a schematic plan view showing the manner in which the lid of the closure is assembled to the base of the closure.
Figure 5:
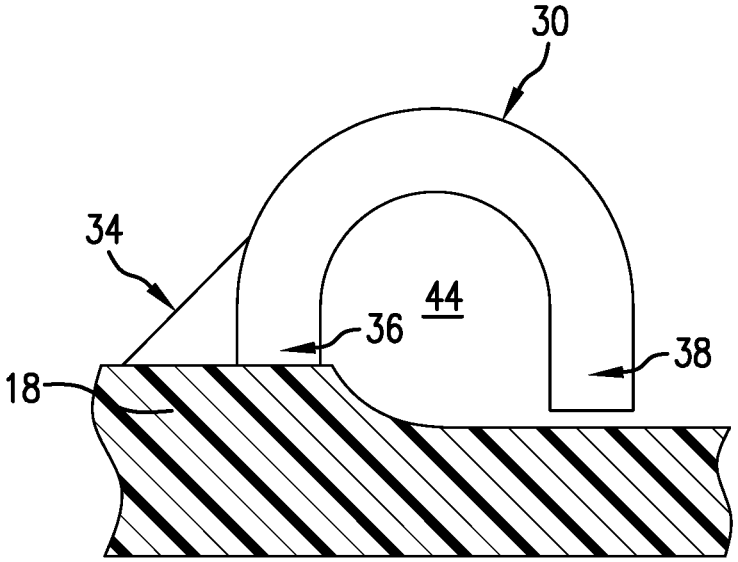
FIG. 5 is an enlarged partially cross-sectional view a portion of the base showing of the structures by which the lid is joined to the base.
Figure 6:
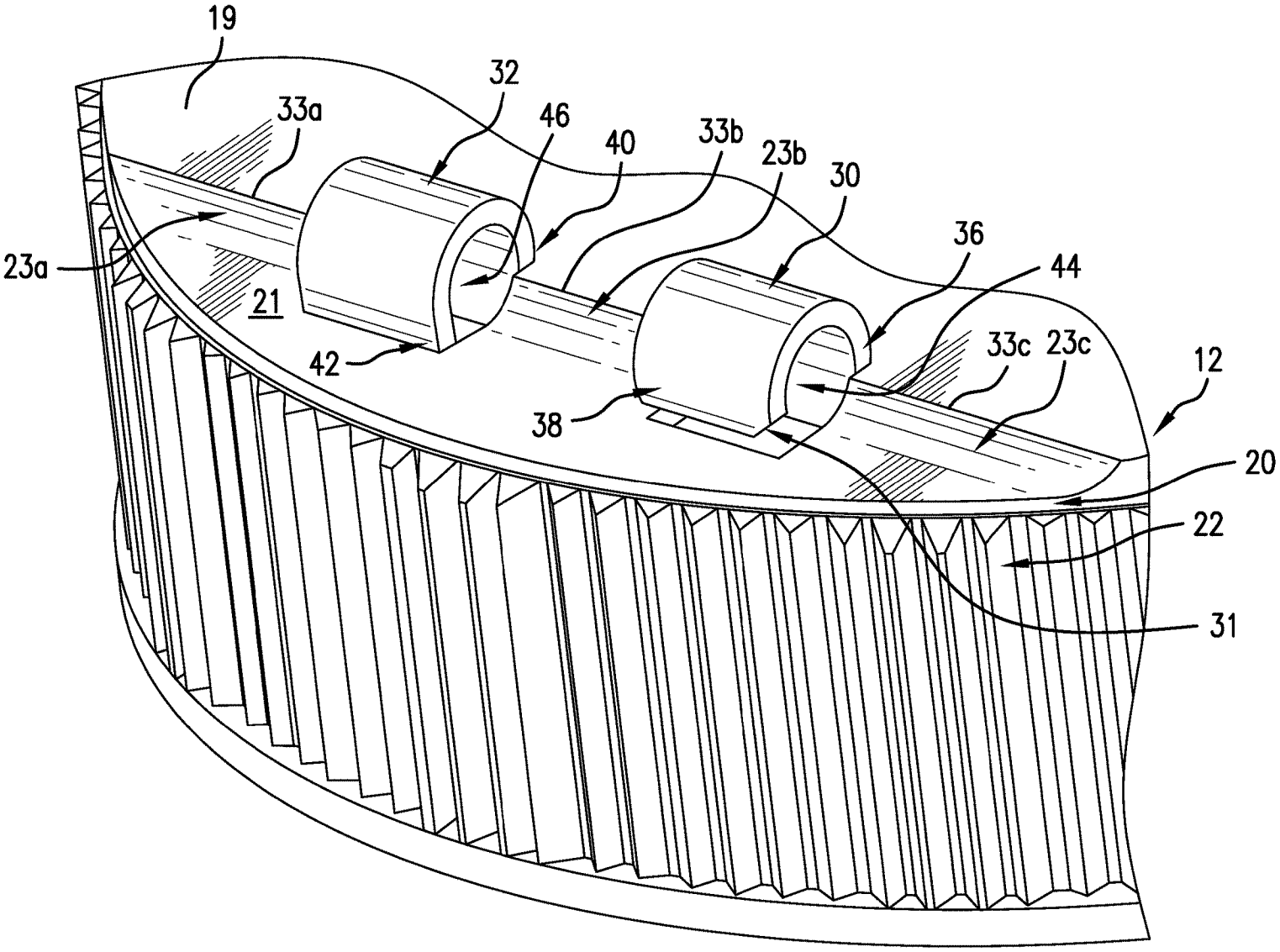
FIG. 6 is a partial perspective view of the structures of the base that are used to connect the lid to the base.

FIG. 3 is a schematic plan view showing the manner by which a lid 14 it is assembled into engagement with a base 12. As shown in FIGS. 5 and 6, the base includes support structures for the post 48 in the form of a hook 30 and a bridge 32. When the lid 14 and base 12 are arranged as shown in FIG. 3 and moved relative to each other in the direction of arrow 64, the rounded (and slightly tapered) leading end 52 of the post 48 is inserted into the tunnel section 44 formed by the hook 30. Upon further movement of the post 48 in the direction of the arrow 64 into the first tunnel section 44 the beveled leading edge 31 (FIG. 6) on the outwardly facing edge of the free distal end 38 of the hook 30 prevents interference between the tab 50 and the hook 30, and pushing the post 48 of the lid 14 into the tunnel sections 44 and 46 lifts the hook 30 upward. The hook 30 is flexible enough to bend upwardly (even with the additional support afforded by the buttress 34). This flexibility allow the tab 50 to slide under the free distal end 38 of the hook 30. During the sliding assembly depicted in FIG. 3, as the tab 50 reaches and abuts the second end 42 of the bridge 32, and the leading end 52 of the post 48 is inside the second tunnel section 46 under the bridge 32. When the post 48 is fully inserted in to the tunnel sections 44 and 46 (i.e., the leading end of the post within the hook 30 and the trailing end of the post 54 within the bridge 32 and the center section 56 of the post is disposed between the hook 30 and bridge 32), the free distal end 38 of the hook 30 returns to a position whereby its distal free end is again close to the flange 18. In this position, non-beveled inside lower edge of the free end 38 restricts movement of the tab 50 in a direction that would result in disassembly of the lid 14 and base 12. The free end 38 the hook blocks the post from movement out of the tunnel sections 44 and 46. That is, the free end 38 of the hook 30 will abut the tab 50 when the lid is moved in sliding outward direction, i.e., the reverse of the direction shown by the arrow 64. When assembled, the tab 50 is disposed between the hook 30 and the bridge 32, and the lid 14 can rotate about the post 48 to open and close the closure 10.

When the lid 14 is in its closed position, the plug 15 abuts and seals against the lip 26 of the base 12, and the opening 28 in the base 12 is closed by the cover 47. The closure 10 of the present invention is preferably initially (as provided to a bottler) equipped with a foil liner (not shown) that has a heat sealable layer on its underside. The foil liner (when attached by induction heating to a container neck) provides the closure 10 with a tamper evident seal. When a consumer purchases a container having a lid of the present invention, the foil liner prevents access to the contents of the container. When the consumer wants to dispense the contents, the threaded base 12 is unscrewed, the foil liner is removed, the closure 10 is put back onto the container, the lid 14 is opened by disengaging the bead 60 from the bead 62 and rotating the lid 14 about the post 28, and the desired amount of contents is dispensed. After dispensing, the consumer pushes the lid 14 back into engagement with the base 12, by pressing down on the lid, forcing the bead 60 to snap past the bead 62. This snapping engagement is coincident with the plug 15 engages and seals against the lip 26 on the flange 18. The seal between the plug 15 and the lip 26 help preserve the contents of the container, and limits spillage of the contents from the container.

The bead 60 on the lower interior end of the portion of the lid skirt 49, and bead 62 on an upper portion of the base 12 are both disposed opposite the respective hinge structures on the lid 14 and base 14. The beads are preferably semi-circular in cross-section and preferably have diameter of about 0.032 inches. The beads 60 and 62 are preferably designed to have a center-to-center distance (i.e. the bead 60 passing over and lying below the bead 62 to create such distance), when the lid 14 an base 12 engaged in an uninstalled condition (i.e., not on a container) of about 0.079 inches. It has been found that this extra distance is needed to accommodate the "doming" or upward displacement of the flange 18, and spreading of the skirt 16 of the base 12, as the cap is tightened onto a container. When the closure shown herein is tightened onto a container, and the doming and related stretching and displacement of closure components occurs, a bead arrangement as describe above will allow effective and repeatable latching of the lid 14 to base 14, by the snapping engagement of bead 60 with bead 62.

Figure 4:
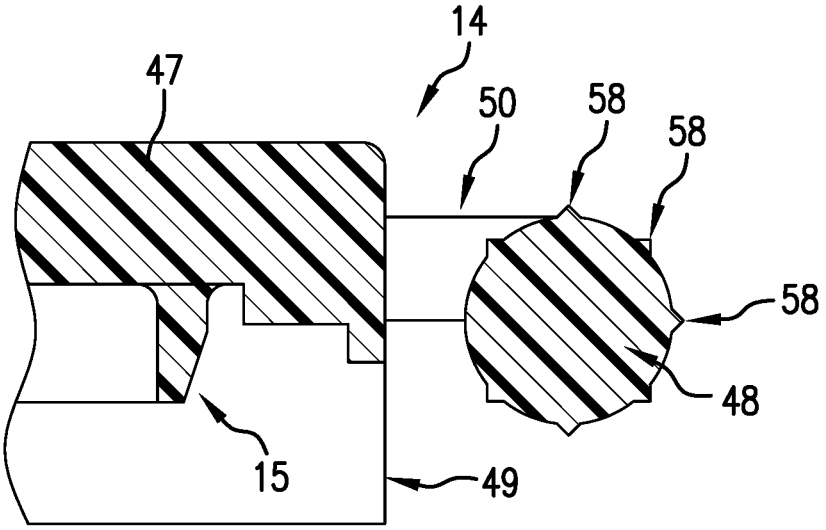
FIG. 4 is an enlarged cross-sectional the lid of figure one showing a portion of the change used to connect the lid of FIG. 1 to the base of FIG. 2.

As depicted in FIG. 4, a series of splines 58 extend axially along the post 48, and the splines 58 are space equally about the periphery of the post 48. The eight splines 58 have a relatively small height (about 0.003 inches). The inside surfaces of the hook 30 and bridge 32 are shaped to grip and engage the splines 58 on the exterior of the post 48. The purpose of the splines 58 is to provide the hinge formed by the post 48, hook 30 and bridge 32 accommodate lids 14 of different color. It has been found that different colorants used in plastics, such as low density polyethylene, results in parts having somewhat different shrinkage rates. It is preferable for the post 48 to fit tightly within the tunnel sections 44 and 46 to create friction between the leading end 52 of the post 48 the and the bridge 32 and between the trailing end of the post 54 and the hook 30, so that the lid 14 will be held in an open position as contents of a container used with the closure 10 are dispensed.

FIG. 5 shows the hook 30 which, along with the post 48 and the bridge 32 (FIG. 6), forms the hinge about which the lid 14 pivots with respect to the base 12. The hook 30 has a free distal end 38 and a fixed proximal end 36 integrally formed with the flange 18 of the base 12. A buttress 34 is disposed adjacent to the fixed proximal end 36 to provide the hook 30 with added support to hold the trailing end 52 of the post 48 in place. A slot 35 is formed in the lid 14 to allow the lid pivot past the buttress 34 allowing the lid 14 to close against the base 12 without interference from the buttress 34.

FIG. 4 also shows that the tab 50 has an upper surface that is tangent to the post 48. The distance between the top surface of the tab 50 (and thus the upper surface of the post 48) and the upper surface of the cover 47 of the lid 14 is approximately equal to the thickness of the material that forms the hook 30 and the thickness of the material that forms the bridge 32. This means that the hook 30 and bridge 32 will not extend a significant distance above the upper surface of the cover 47. In addition, when the lid 14 is connected to the base 13, the hinge components (i.e., the post 48, hook 30 and bridge 32) to not project laterally beyond the perimeter of the skirt 16 and do not project above the top of the lid 14 by any appreciable or significant distance. Thus, the hinge of the closure 10 is disposed generally within a space the upper boundary of which is defined by a plane corresponding to the upper surface of the lid 14 and the lateral boundary of which is defined by a cylinder corresponding to the skirt 16. Flexing of the hook 30 and deformation of the bridge 32 may cause those structures to protrude slightly above the plane defined by the upper surface of the lid 14, but as long as that protrusion is relatively small (less than the thickness of the post support, which in the embodiment described herein is a two-part post support in the form of a hook 30 and bridge 32), the hinge structures will still fall generally within the boundaries describe above and will not interfere with the performance of the closure during the feeding operation.

The base 12 has knurls 22 formed on the skirt 16, such that the top of the knurls 22 form a shoulder. The knurls preferably have varying height (FIG. 6) and the lid 14 has a downwardly depending lid skirt 49 that is shaped to fit around an upper knurl-free portion 17 of the skirt 16. The lid skirt 49 has a outside diameter that is approximately equal to the outside diameter of the knurled section (i.e., the O.D. corresponding to the largest of the knurls), so that the lid skirt 49 is approximately equal in diameter to the diameter of the knurls, and the lower end of the lid skirt 49 lies just above the shoulder 20, when the lid 14 is in a closed position on the base 12. With this configuration, the cap has overall shape that approximates the shape of a standard unitary cap.

These parameters mean that the closure 10 of the present invention will have very similar proportions to standard unitary closures and it will perform well in standard feed systems, such as vibratory feeding bowls and ramp systems of the type that are currently used to feed standard, unitary closures. This means that the closures of the present invention can be used interchangeably with standard caps without any need to replace or otherwise change or modify the closure feeding equipment used in a bottling facility.

An additional purpose and benefit of the closures describe herein is to allow different colored lids 14 to be used with a single (or standard) colored base 12. This allows cap manufacturer to supply a bottler (of milk, for example) with closures that have a single standard base 12, and the cap manufacturer can on very short notice supply caps having a particular color lid 14 (e.g., light blue for skim milk, red for whole milk or yellow for 1%, brown for chocolate etc.) without having actually prepare an injection mold and manufacture a particular cap in response to an order. The manufacturer can simple have a supply of base components on hand and a supply of different colored lids on hand and can quickly assembly the color combinations that a bottler requires. By forming splines 58 on the exterior of the post 48, a lid 14 can be made to have a sufficient frictional hold between the lid 14 and the base 12, regardless of color and the associated variability in shrinkage properties resulting from the use of different colorants. This system has the additional advantage that a single lid mold can be used to form lids of all of the colors (blue, red, yellow, brown etc.) that a customer may desire, because the forgiveness afforded the splines will allow lids with different shrinkage properties to perform as needed. The friction between the splines 58 and the inside surfaces of the tunnel sections 44 and 46 (formed by the hook 30 and bridge 32, respectively) will hold the lid in an open position and resist the tendency for the lid 14 to be pulled to a closed position onto the base 12 by gravity.

Figure 7:
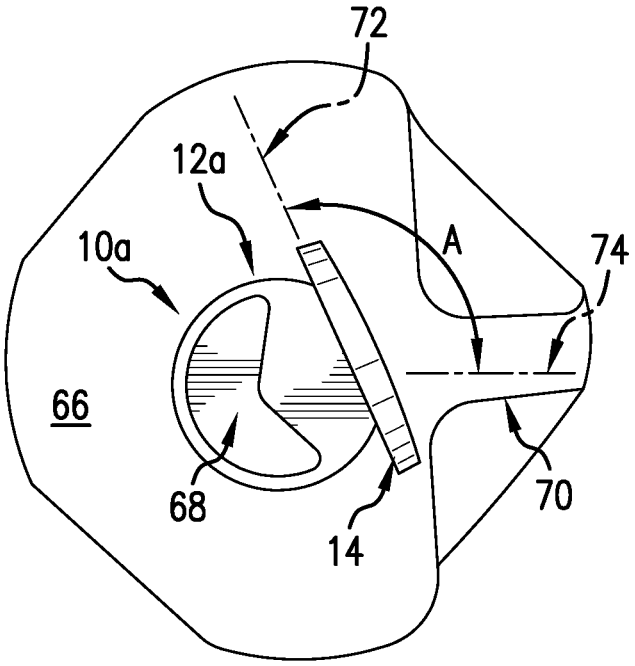
FIGS. 7 and 8 show an alternative cap on a bottle with and without a foil liner in place, respectively.
Figure 8:
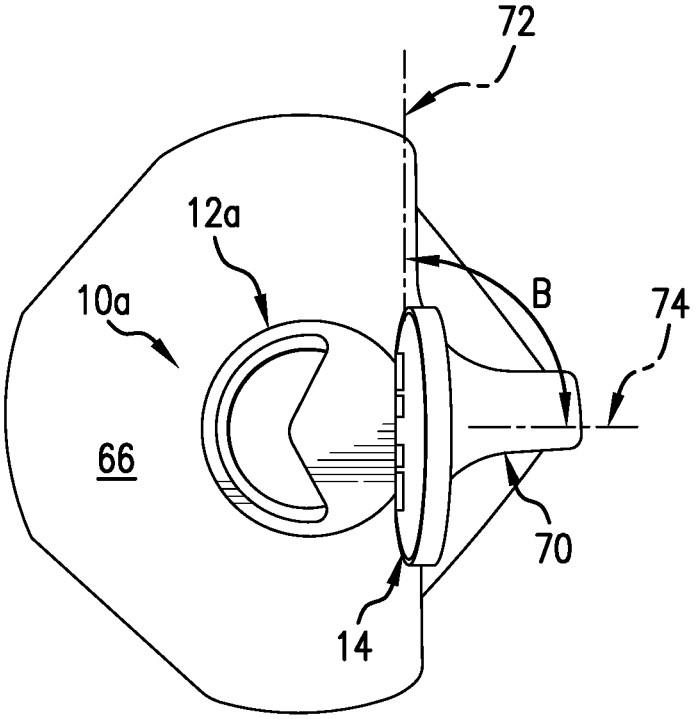

FIG. 7 shows a closure 10*a* installed on a container 66 with a foil liner in place, and FIG. 8 shows the same closure 10*a* installed on the same container 66 without a foil liner. These two figures are intended to show that in order for lid 14 of the closure 10*a* to align properly with the handle 70 of the container 66 after the foil liner has been removed, the formation of the single threads on the container and the formation of the single thread on the base of the closure must be coordinated. The thickness of a foil liner 68 is typically about 0.007 inches. This means that, as shown in FIG. 7, the liner 86 will prevent the cap from being threaded down far enough to have the lid 14 align so that the axis of the hinge will align as it should (as shown in FIG. 8) for proper use and dispensing. It is preferable to have the axis of the hinge (shown by line 72 in FIGS. 7 and 8) be approximately perpendicular to the axis of the handle (shown by line 74), when the contents of the container are being dispensed. The presence of the liner 68 causes the angle between the axis 74 of the handle and the axis of the hinge 72 to be larger (i.e., angle A of about 115 to 120 degrees in FIG. 7). However, when the liner 68 is removed, the axis 74 of the handle and the axis of the hinge 72 assume a preferable alignment of about 90 degrees (i.e., angle B in FIG. 8). To achieve the desired alignment, as shown in FIG. 8, formation of the single thread of the container and the formation of single thread of the closure need to be coordinated, i.e., each needs to be formed with the other in mind, and that formation must take into consideration the effect of the foil liner being removed, so that the alignment of the axis 74 of the handle 70 is about 90 degrees with respect to the axis 72 of the hinge for the enduser when dispensing is desired.

As shown in FIG. 6, the upper surface of the base 12 includes three main surfaces, an upper planar surface 19, a second smaller planar platform 21 and a transition surface comprised of three segments, 23*a*, 23*b* and 23*c*, which in this case are curved in a concave manner. The intersection of the upper surface 19 and the transition surfaces 23*a*, 23*b* and 23*c* defines a series of ledges 33*a*, 33*b* and 33*c*, which are in axial alignment with each other. The first transition surface 23*a* and the first ledge 33*a* extend from the outer edge of the base 12*a* to one side of the bridge 32. The second transition surface 23*b* and second ledge segment 33*b* extend between the bridge 32 and the hook 30. The third transition surface 23*c* and third ledge segment 33*c* extend from one side of the hook 30 to the outer edge of the base 12*a*. The platform 21 is vertically offset in the downward direction with respect to the upper surface 19, and thus has a lower elevation.

Figure 9:
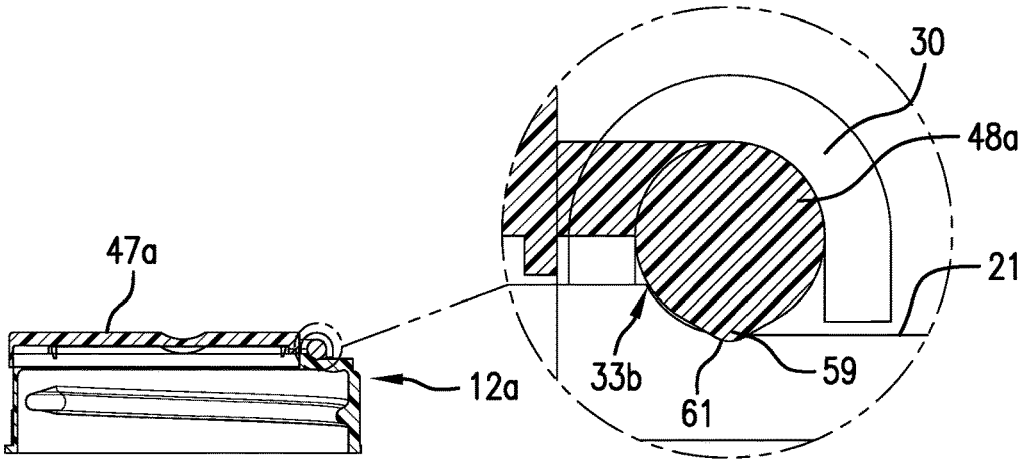
FIGS. 9, 10 and 11 are a series of elevational views showing an alternative embodiments in which the lid of the cap is held in closed, partially open and fully open positions, respectively.
Figure 10:
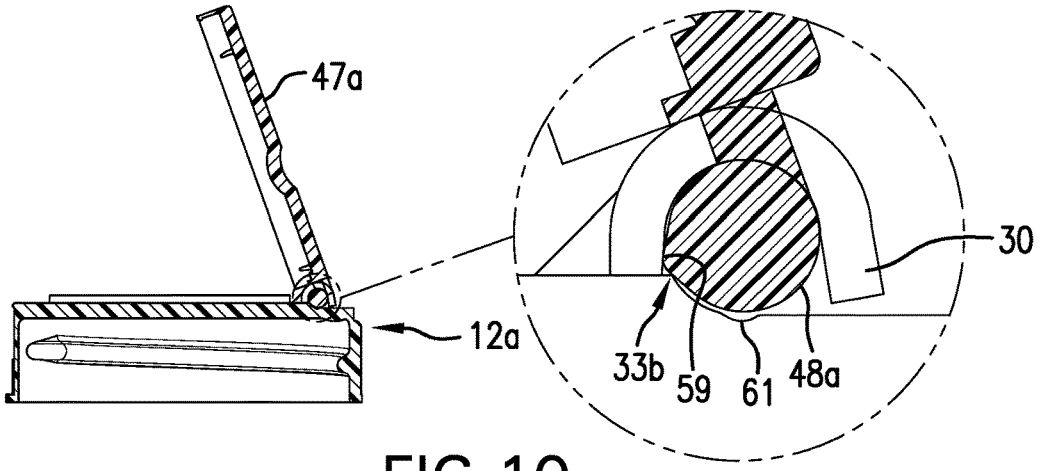
Figure 11:
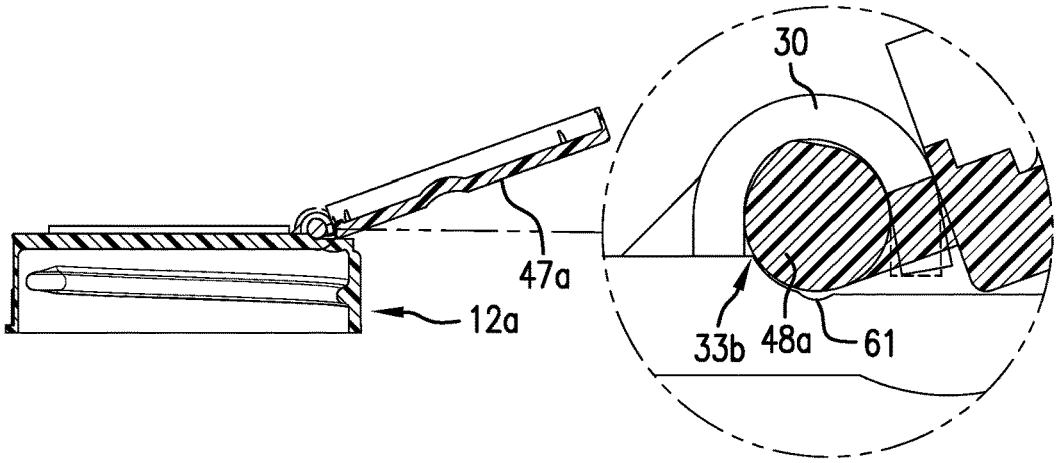

As shown in FIGS. 9-11, the ledges engage a protrusion 59 formed on the post 48*a* to hold the closure cover 47*a* in a partially open position (about 70 degrees from horizontal, as shown in FIGS. 9-11). The proximal ends of the bridge 32 and tunnel 36 just above their respective intersections with the upper planar surface 19 of the base 12 cooperate with the ledges to hold the lid 47*a* against rotation, one side of the protrustion being held by the proximal ends of the bridge 32 and tunnel 30, and an opposing side of the protrusion 59 being held by the ledges 33*a*, 33*b* and 33*c*. Similarly, in the embodiment of FIG. 4, a spline 58, is held on opposing sides by the proximal ends of the bridge 32 and tunnel 30 and the ledges 33*a*, 33*b* and 33*c*. With reference to the FIG. 4 post 48 having protrusions in the form of splines 58, the ledges 33*a*, 33*b* and 33*c* would engage and hold the cover 47*a* in a variety of positions when one side of any one of the splines 58 on the post 48 shown in FIG. 4 engages the ledges 33*a*, 33*b* and 33*c*, and an opposing side of the same one of the spline 58 engages the proximal ends of the bridge 32 and tunnel 30. FIGS. 9-11 also show that the platform 19 has an indentation 61 that serves to hold the cover 47 in the closed position, as shown in FIG. 9.

It should be noted that while the closure discussed herein is useful on closures used to deliver beverages, the flip-top closure of the present invention can be used in a wide variety of applications, including medicines (both solid, i.e., pills, and liquids, and a wide variety of other liquids and solids, such as syrups and spices, for example.

The foregoing descriptions of specific embodiments have been presented for purposes of illustration. They are only examples and are not intended to a basis for limiting the scope of the inventions claimed below. It will be apparent to persons of ordinary skill in the field of closure design that many modifications, variations and substitutions are possible in light of the above teachings. The embodiments were chosen and described in order to explain the principles of the inventions claimed below and to demonstrate practical application thereof, and to thereby enable others of ordinary skill in the art to utilize the claimed inventions.

We claim:

1. A closure comprising:

a base having a skirt and at least one internal thread formed on an inside surface of the skirt, the base having an opening;

a lid having a depending plug shaped to fit at least partially into the opening of the base;

a hinge joining the base and the lid, the hinge comprising:

a post carried by the lid, the post being integrally connected to the lid by a tab;

at least two post supports extending upwardly from the base, one post support being a bridge having a first end and a second end, each of the ends of the bridge being integrally joined to the base, the bridge defining a first tunnel section adapted to receive a first portion of the post, a second post support being a hook with a proximal end being integrally joined to the base and the hook having a free distal end, the hook forming a second tunnel section adapted to receive a second portion of the post, the first and second portions of the post being separated by a middle portion of the post, the middle portion being joined by the tab to the lid, the post having at least one outwardly extending protrusion, a ledge disposed at an upper surface of the base, the ledge adapted to engage the protrusion and hold the lid in a partially open position wherein the ledge extends beyond the first post support and the second post support.

2. A closure of claim 1 further comprising:

the ledge being comprised of three segments and the protrusion being selected from the group consisting of a triangular outwardly pointing spline extending along the length of the post and a rounded protrusion extending along the length of the post.

3. A closure of claim 1 further comprising:

the post having a rounded protrusion adapted to hold the lid open at an angle of about 70 degrees with respect to the base when engaging said ledge.

4. A closure of claim 1 further comprising:

a beveled portion on the free distal end of the hook, whereby during assembly of the lid to the base, the beveled portion will guide the tab under the distal end of the hook.

5. A closure of claim 1 further comprising:

a buttress formed adjacent an intersection of the proximal end of the hook and the base, whereby the buttress provides the hook with improved resistance to bending from upward forces applied to an inner surface of the hook by the second portion of the post.

6. A closure of claim 1 further comprising:

the at least one thread formed on an inside surface of the skirt being a single helical thread adapted to mate with a single helical thread on a bottle, whereby the closure when installed on a bottle having a handle will generally have a single alignment in which the direction of opening of the lid will correspond to the location of the handle.

7. A closure of claim 1 further comprising:

a first latch bead on the base and a second latch bead on the lid, the first and second latch beads being positioned to snap past one another and hold the lid in a closed position over the opening in the base.

8. A closure of claim 1 further comprising:

the post having at least one generally axially extending external spline, the spline adapted to engage the ledge to hold the lid in an open position.

9. A closure of claim 1 wherein the bridge and the hook have a height that is approximately equal to an elevation of an upper surface of the lid when the lid is attached to the base, and the base includes a platform from which the bridge and hook extend upwardly, the bridge and hook being disposed in plan view within the periphery of the closure, whereby the hinge does not extend either radially from the closure beyond the skirt or axially a substantial distance beyond the lid, when the lid is assembled to the base.

10. A closure of claim 1 wherein the skirt has a lower skirt section and an upper skirt section, and axially extending knurls are disposed over a major portion of an exterior surface of the lower skirt section, an upper portion of the skirt section being with knurls, such that the top of the knurls form a shoulder, and the lid having a downwardly depending lid skirt that is shaped to fit around an upper portion of the skirt, the lid skirt having a thickness that is approximately equal to the depth of at least some of the knurls.

11. A closure of claim 1 wherein the lid is made of a plastic containing a first colorant, and the base is made of a plastic containing a second colorant, and the first and second colorants are different.

12. A two-piece closure comprising:

a base having a skirt a thread formed on an inside surface of the skirt, the base having an opening;

a lid having a depending plug shaped to fit into the opening of the base;

a hinge joining the base and the lid while allowing rotation of the lid relative to the base, the hinge comprising:

a post carried by the lid, the post being integrally connected to the lid by a tab and having an outer surface with at least one protrusion;

at least one post support extending upwardly from the base, the at least one post support being integrally connected to the base and defining a tunnel adapted to receive a portion of the post, the post being joined to the lid by a tab;

the base having two planar surfaces, a first upper planar surface and a second upper planar surface vertically offset with respect to the first upper planar surface, the second upper planar surface defining a platform, the first and second upper planar surfaces being joined by a transition surface, the first upper planar surface defining a ledge at an intersection of the first upper planar surface and the transition surface, the post having the at least one protrusion extending outwardly, the ledge adapted to engage the at least one protrusion and hold the lid in a partially open position, wherein the ledge extends beyond the at least one post support.

13. A closure of claim 12 wherein the post support is comprised of two upwardly extending formations, one formation being a hook having a fixed end and a free end, and a second formation being bridge having two fixed ends, each of the hook and bridge defining a tunnel section for receiving portions of the post.

14. A closure of claim 12 wherein a beveled portion is formed on the free end of a hook, whereby during assembly of the lid to the base, the beveled portion adapted to guide the tab under the distal end of the hook during a sliding assembly of the lid to the base.

15. A closure of claim 12 wherein the tab has a width that is less than a distance that separates a hook and a bridge, such that when the tab slides under the free end of the hook and is disposed between the hook and the bridge, the hook moves in the direction of an original position of the hook and the free end of the hook blocks the tab and restricts disassembly of the lid from the base.

16. A closure in accordance with claim 12 wherein the lid and the base have different colors.

17. A closure in accordance with claim 12 wherein the base has a single helical internal thread formed on the inside of the skirt.

18. A closure in accordance with claim 12 wherein the at least one outwardly extending protrusion being selected from the group consisting of a triangular outwardly extending spline disposed along the length of the post and a rounded protrusion disposed along the length of the post.

19. A closure comprising:

a base having a skirt and a single internal thread formed on an inside surface of the skirt, the base having an opening;

a lid having a depending plug shaped to fit at least partially into the opening of the base;

a hinge joining the base and the lid, the hinge comprising:

a post carried by the lid, the post being integrally connected to the lid by a tab, the hinge having at least one protrusion;

at least two post supports extending upwardly from the base, one post support being a bridge having a first end and a second end, each of the ends of the bridge being integrally joined to the base, the bridge defining a first tunnel section, a second post support being a hook with a proximal end being integrally joined to the base and the hook having a free distal end, the hook forming a second tunnel section, the first and second portions of the post being separated by a middle portion of the post, the middle portion being joined by the tab to the lid; a plurality of upwardly facing surfaces of the base comprising a first uppermost planar surface, a second planar surface forming a platform and being offset vertically with respect to the first uppermost planar surface, and a transition surface connecting the first uppermost planar surface and the platform;

a ledge formed at the intersection of the uppermost planar surface and the transition surface, wherein the ledge extends beyond the at least two supports, the hinge being disposed substantially within a space defined by a plane corresponding to the upper surface of the lid, and a cylinder generally corresponding to an outermost portion of the skirt.

20. A closure in accordance with claim 19 wherein the protrusion on the post us adapted to engage the ledge and hold the lid in a partially open position.

* * * * *